United States Patent [19]

Asari et al.

[11] Patent Number: 4,708,627

[45] Date of Patent: Nov. 24, 1987

[54] HIGH PRESSURE APPARATUS

[75] Inventors: Akira Asari, Ohsaka; Youichi Inoue, Ashiya, both of Japan

[73] Assignee: Kabushiki Kaisha Kobe Seiko Sho, Kobe, Japan

[21] Appl. No.: 946,643

[22] Filed: Dec. 29, 1986

Related U.S. Application Data

[63] Continuation of Ser. No. 749,464, Jun. 27, 1985, abandoned.

[30] Foreign Application Priority Data

Jul. 13, 1984 [JP] Japan ..... 59-106598[U]

[51] Int. Cl.[4] ..... B30B 11/00

[52] U.S. Cl. ..... 425/405 H; 419/49; 425/451.9

[58] Field of Search ..... 419/49; 425/77, 78, 425/153, 405 R, 405 H, 450.1, 451, 451.9, 595, DIG. 221, DIG. 222

[56] References Cited

U.S. PATENT DOCUMENTS

| | | | |
|---|---|---|---|
| 2,544,414 | 3/1951 | Bridgman | 425/77 |
| 3,550,199 | 12/1970 | Landa | 425/405 H |
| 3,698,843 | 10/1972 | Bowles | 425/405 H |
| 4,345,893 | 8/1982 | Prince | 425/DIG. 221 |
| 4,484,881 | 11/1984 | Asari et al. | 425/405 H |
| 4,563,143 | 1/1986 | Pettersson | 425/405 H |

*Primary Examiner*—Jay H. Woo
*Assistant Examiner*—J. Fortenberry
*Attorney, Agent, or Firm*—Oblon, Fisher, Spivak, McClelland & Maier

[57] ABSTRACT

A high pressure apparatus in which a support frame which undergoes axial tension includes a divided body composed of first and second support frames, the first and second support frames being brought into engagement with each other at an outward area in a diametrical direction of upper and lower covers and being freely changed in position between the engaging position and a position separated from each other. Either one or both of the upper and lower covers are provided with a member which extends outwardly in an axial direction so that products may be removed from a cylindrical high pressure container.

4 Claims, 9 Drawing Figures

HIGH PRESSURE APPARATUS

This application is a continuation of application Ser. No. 749,464, filed June 27, 1985, now abandoned.

BACKGROUND OF THE INVENTION

1. Field of the Invention

The present invention relates to various high pressure apparatuses such as a cold isostatic pressing apparatus, a hot isostatic pressing apparatus and the like.

2. Discussion of the Background

In high pressure apparatuses such as a cold isostatic pressing apparatus, a hot isostatic pressing apparatus and the like, axial tension resulting from internal pressure of a container greatly acts thereon, and therefore, there is provided a support frame in engagement with upper and lower covers in upper and lower closing portions of the container. One example of such prior art, Japanese Utility Model Publication No. 50238/83, is disclosed.

The aforesaid conventional support frame (press frame) is of an integral construction in engagement with the whole of the upper and lower covers, and accordingly, it has been difficult to provide members which extend outwardly in an axial direction, for example, such as a means for inserting and removing a push rod, a cover opening and closing cylinder, etc., on the center shaft of the container.

SUMMARY OF THE INVENTION

In accordance with the present invention, a support frame under axial tension comprises a divided body composed of a first support frame and a second support frame, and the first and second support frames are brought into engagement with each other at an outward area in a diametrical direction of upper and lower covers and are freely changed in position between said engaging position and a position separated from each other.

Further, either one or both of the upper and lower covers are provided with a member which extends outwardly in an axial direction so that products may be removed from the container.

Accordingly, in the high pressure apparatus according to the present invention, the first support frame and the second support frame are brought into engagement with the upper and lower covers on both sides of the projecting member, and in this engaging state, the axial tension is withstood despite the support frame being of a divided form.

Moreover, inserting and removing molded articles and products may be accomplished by the projecting member, in which case, the first frame and second frame are withdrawn in a direction wherein they are separated from each other outwardly in a diametrical direction as indicated by the chain line of FIG. 1, thus avoiding interference with the projecting member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
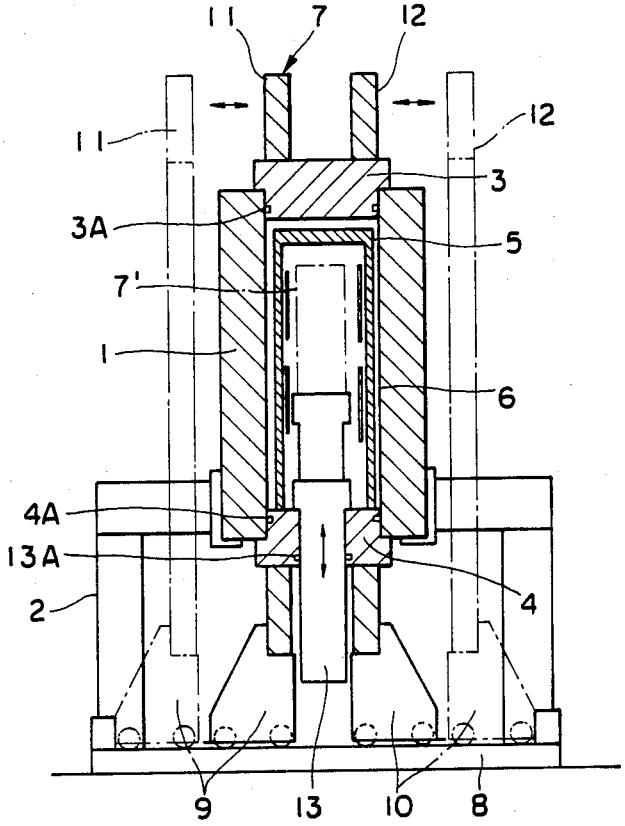
FIG. 1 is a sectional view in elevation showing a first embodiment of the present invention.

In accordance with the present invention, a support frame 7 which undergoes axial tension and which comprises a divided body composed of a first support frame 11 and a second support frame 12, and the first and second support frames 11 and 12 are brought into contact with upper and/or lower covers 3 and 4 in an outward area in a diametrical direction thereof and can have the position thereof freely changed between said contact position and a separate position.

Further, either one or both of the upper and lower covers are provided with a member 13 which extends outwardly in an axial direction so that products may be removed from a cylindrical high pressure container 1.

Accordingly, in the high pressure apparatus according to the present invention, the first support frame 11 and the second support frame 12 are brought into engagement with the upper and lower covers 3 and 4 on both sides of the projecting member 13, and in this engaging stage, the axial tension is withstood despite of the support frame being of a divided form. (See FIG. 1)

Moreover, inserting and removing molded articles and products may be accomplished by the projecting member 13, in which case the first frame and second frame are withdrawn in a direction where they are separated from each other outwardly in a diametral direction as indicated by the chain line of FIG. 1, thus avoiding interference with the projecting member 13.

Figure 2:
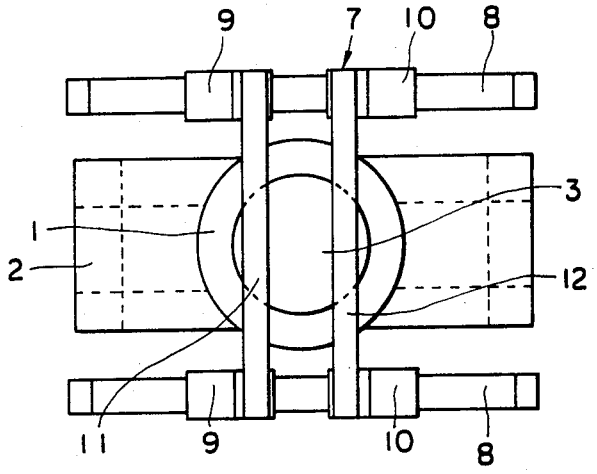
FIG. 2 is a plan view of FIG. 1.

FIGS. 1 and 2 show a first embodiment of the present invention. The cylindrical high pressure container 1 is secured to a frame 2 and the container 1 is formed at upper and lower portions thereof with closing portions. respectively. The upper and lower open portions of the container 1 are sealed by upper and lower covers 3 and 4 through seal members 3A and 4A.

In case of hot isostatic forming process (HIP), the container 1 is interiorly provided with heating elements such as a heat insulating layer 5, a heater 6 and the like, and a molded article 7' may be pressed and processed isotropically by making use of synergetic effect of pressure higher than 1000 kg f/cm$^2$ and temperature higher than 1000° C. in a normal case using inert gas such as argon as a pressure medium.

There is provided a support frame 7 for carrying an axial tension during the pressing and processing. The support frame 7 is composed of first support frame 11 and second support frame 12 which are provided on carriages 9 and 10, respectively, capable of traveling on rails 8. The frames 11 and 12 are brought into engagement with upper and lower covers 3 and 4 at the position indicated as the solid line of FIG. 1 to carry the axial tension, may be withdrawn in a direction separated from each other towards the position as indicated by the chain line of FIG. 1, and may be freely changed in position between the pressing position and the withdrawn position.

In the embodiment of FIG. 1, there is provided a member 13 axially acting on the lower cover 4 at the center of the shaft through a seal member 13A, and in the illustrated embodiment, there is provided a member for inserting and removing a molded article, said member 13 being projected or extended outwardly in an axial direction.

Figure 3:
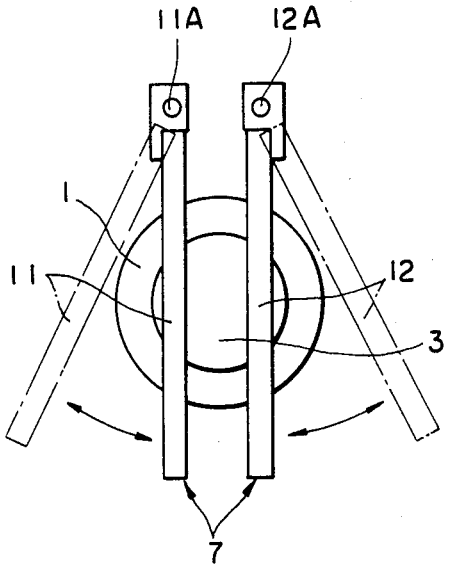
FIG. 3 is a plan view of a second embodiment of the present invention.

Referring to FIG. 3, there is shown a second embodiment of the present invention.

In the second embodiment, the first support frame 11 and the second support frame 12 are made rotatable about longitudinal pivot portions 11A and 12A on the same side.

Figure 4:
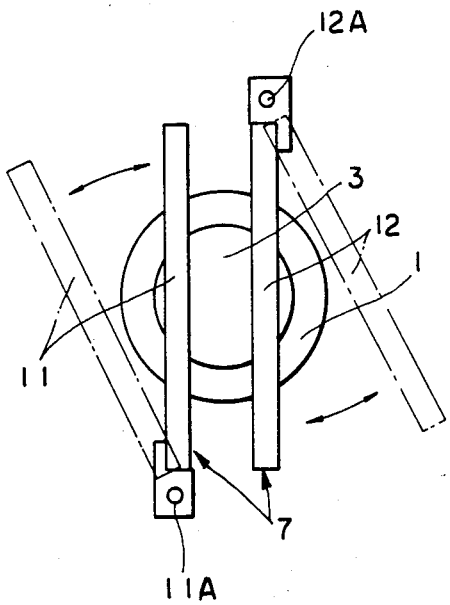
FIG. 4 is a plan view showing a third embodiment of the present invention.

FIG. 4 shows a third embodiment of the present invention, in which the first support frame 11 and the second support frame 12 are rotatable about the pivot portions 11A and 12A on the opposite side.

Figure 5:
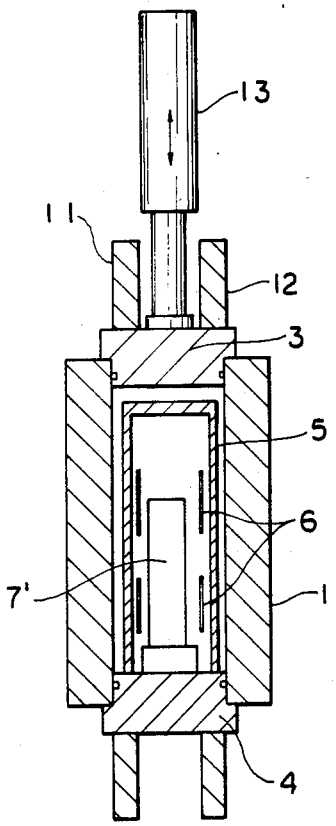
FIG. 5 is a sectional view in elevation showing a fourth embodiment of the present invention.
Figure 7:
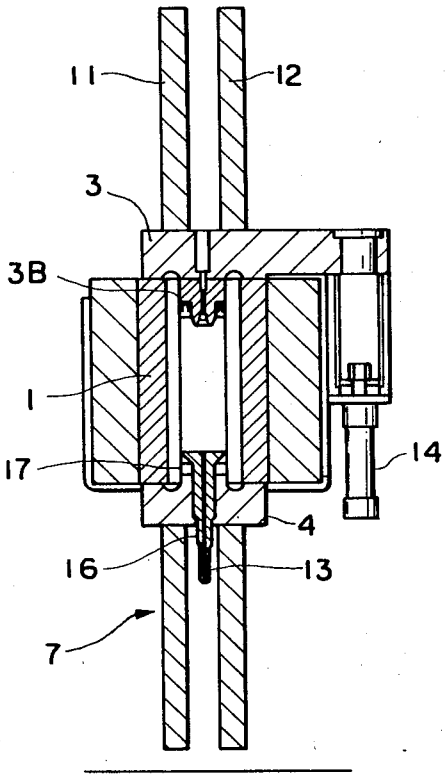
FIG. 7 is a sectional view thereof.
Figure 6:
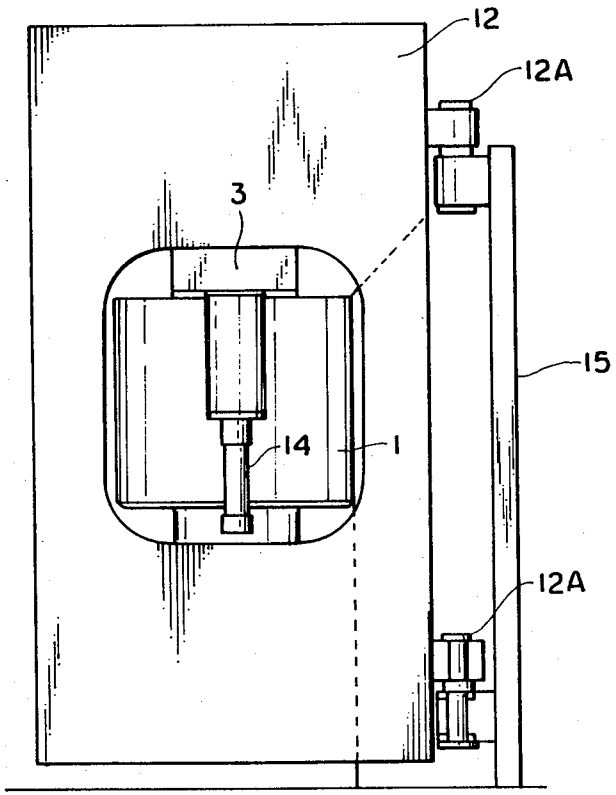
FIG. 6 is a front view in which the present invention is applied to an isostatic press.

In a fourth embodiment shown in FIG. 5, a projecting member 13 outwardly in an axial direction is provided in which a cover opening and closing cylinder mechanism is provided on the side of the upper cover 3.

It should be noted that the aforementioned embodiments can be combined. For example, the projecting members can be provided on the upper and lower covers, respectively. Futher, the support frame can be of the mono-block type, steel-plate laminated type, steel-plate wound type, wire-wound type, and the like.

Also, the present invention can be applied to high pressure apparatuses such as CIP, high pressure impregnation or the like, in addition to the illustrated HIP.

FIGS. 6 to 9 show examples in which the second embodiment is applied to an isostatic extrusion press. In FIGS. 6 to 9, the upper cover 3 of the container 1 has a die 3B detachably attached to the lower surface thereof, and an extruded material removing hole 3A is formed in the shaft centre common to a die hole.

Figure 8:
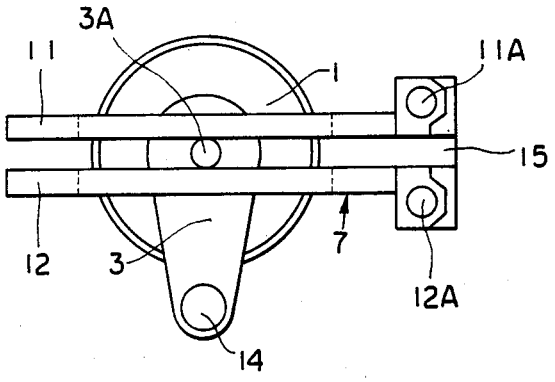
FIGS. 8 and 9 are respectively plan views showing the states prior to and subsequent to operation.
Figure 9:
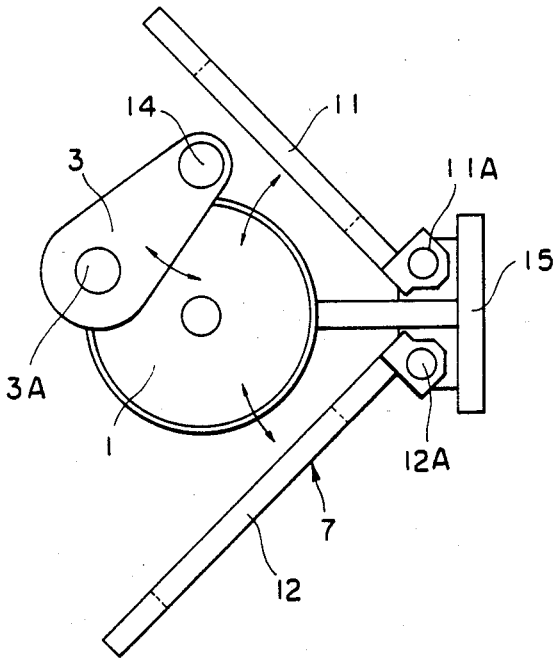

The die 3B can be inserted into and removed from the container 1 by a vertically movable cylinder mechanism 14. The support frames 11 and 12 rotatable around the pivot members 11A and 12A are withdrawn as shown in FIG. 9 and thereafter the upper cover 3 is made turnable, and during the extrusion, the support frames 11 and 12 are closed as shown in FIG. 8 to undergo axial tension.

A pressure medium supply member in the form of projecting member 13 is inserted into the center of the shaft of the lower cover 4 and fastened by a nut 16, and a booster is connected to the member 13 through a pipe (not shown).

Reference numeral 15 designates a fixed frame, and 17 designates a seal, which operation is the same as that of the first embodiment.

In the present invention, a support frame 7 carrying an axial tension is composed of two members, one for a first support frame 11 and the other for a second support frame 12, and these frames are brought into engagement with upper and lower covers 3 and 4 at the pressing position, which position can be freely changed in position to a withdrawn position. Thus, even if this frame is of the divided type, it can sufficiently carry axial tension.

Moreover, since the support frames 11 and 12 are withdrawn in a direction where they are separated from each other outwardly in a diametrical direction from the engaging position, the projecting member 13 can be provided on the center of the shaft without difficulty, thus eliminating interference with the projecting member 13. Accordingly, the apparatus according to the present invention is useful for high pressure apparatus such as HIP and CIP.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high pressure apparatus, comprising:

a cylindrical high pressure stationary container having a longitudinal axis;

movable upper and lower covers for sealing upper and lower open portions of said high pressure container;

a movable support frame which undergoes axial tension and which engages simultaneously said upper and lower covers, said movable support frame being freely changed in position between a pressing position and a withdrawn position, wherein said movable support frame further comprises a first support frame and a second support frame, said first support frame being separated from said second support frame and each of said first and second support frames being pivoted about an axis parallel to said longitudinal axis of said container;

a vertically oriented member positionable between said first and second support frames for lifting and lowering an article to be processed within said container and extending axially outwardly of said container and which is provided on at least one of the upper and lower covers in a center shaft portion of the high pressure container;

means for respectively moving said first and second support frames towards one another and for engaging said first and second frames with the upper cover so as to allow for passage of said vertically oriented member therebetween and for withdrawing said first and second support frames outwardly so as to be separated from each other.

2. The apparatus according to claim 1, further comprising means for rotating said first and second support frames around longitudinal pivot portions on a common side of said support frames.

3. The apparatus according to claim 1, further comprising means for rotating said first and second support frames around pivot portions on opposing sides of said support frames.

4. The apparatus according to claim 1, wherein the projecting member is provided on a side where said upper cover is located.

* * * * *